US007086501B1

(12) United States Patent
Saulet

(10) Patent No.: US 7,086,501 B1
(45) Date of Patent: Aug. 8, 2006

(54) ROLLING LADDER

(76) Inventor: Gerald A. Saulet, 1033 Sugarberry Ln., Corona, CA (US) 92882

( * ) Notice: Subject to any disclaimer, the term of this patent is extended or adjusted under 35 U.S.C. 154(b) by 262 days.

(21) Appl. No.: 10/764,351

(22) Filed: Jan. 23, 2004

(51) Int. Cl.
*E06C 7/00* (2006.01)

(52) U.S. Cl. ..... 182/127; 280/79.7; 182/129

(58) Field of Classification Search ..... 182/129, 182/20, 22, 127, 107, 108; 280/30, 47.24, 280/47.131, 79.7
See application file for complete search history.

(56) References Cited

U.S. PATENT DOCUMENTS 1,004,550 A * 10/1911 Bertke ..... 182/21
1,285,918 A * 11/1918 Brown ..... 182/107
1,606,198 A * 11/1926 Werk ..... 182/107
3,954,155 A * 5/1976 Guidara ..... 182/20
4,106,590 A * 8/1978 Tarran ..... 182/20
4,564,203 A * 1/1986 Wilson ..... 280/47.32
6,585,084 B1 * 7/2003 Gannon ..... 182/129
6,592,134 B1 7/2003 Abraham ..... 280/79.7
6,880,835 B1 * 4/2005 Tornabene et al. ..... 280/30

* cited by examiner

*Primary Examiner*—Alvin Chin-Shue
(74) *Attorney, Agent, or Firm*—Edgar W. Averill, Jr.; Kenneth L. Green

(57) ABSTRACT

A ladder with a fixed axle wheel adapted to facilitate relocating the ladder. The ladder may be a step ladder or an extension ladder. The ladder includes a ladder base adapted to reside on a support surface, a ladder top opposite the ladder base, and ladder sides connected by steps, the ladder sides extending between the ladder base and the ladder top. The wheel is attached to one of the sides near the ladder base and is adapted to rollably support the ladder base when the ladder is moved. The wheel may be recessed into an opening on the ladder side to allow a larger diameter wheel to be used.

2 Claims, 7 Drawing Sheets

ROLLING LADDER

BACKGROUND OF THE INVENTION

The present invention relates to a easily transportable ladder, and more specifically to a ladder with a fixed wheel on one side of the base of the ladder.

Maintenance personnel commonly utilize one or more ladders for various tasks. Such ladders may be foldable (or step) ladders, or extension ladders. Step ladders may range from typical household step ladders which are generally six feet high, to maintenance step ladders which may be up to twelve feet high and weigh as much as forty five pounds or more. Extension ladders may similarly vary in length and weight, and may weigh over one hundred pounds.

Maintenance personnel may be required to frequently relocate ladders from one work site to the next, along with moving tools, fixtures, lights, etc. Carrying heavy ladders may prove both difficult and tiring, and therefore fatiguing to a worker, who must then climb the ladder to perform tasks. Such fatigue may result in slower performance of work, or in injury. Further, due to their length, ladders are generally only be carried on the right or left side, and as such, create an uneven load on the carrier's spinal column. In some cases, long term uneven loading may injure the spinal column and/or create liability for an employer.

Attempts have been made to reduce the effort required to move ladders, such as the removable castors taught in U.S. Pat. No. 6,592,134 issued Jul. 15, 2003 for "Ladder Transport Systems." The '134 patent teaches a removable caster held to a ladder by a "C Clamp" type device. While the device of the '134 patent address some of the needs, it does not allow the use of a large non-obtrusive or stable wheel for ladder transportation. A caster type wheel disadvantageously allows a ladder base to run down a slope, creating possibly dangerous situations. Also, the wheel of the '134 patent is entirely outside the profile of the ladder, which either limits the wheel size, or creates an undesirably large extension from the ladder.

Thus, a need remains for maintenance ladders which are easily and steadily transportable and reduce fatigue and injury resulting from carrying heavy ladders between job sites.

BRIEF SUMMARY OF THE INVENTION

The present invention addresses the above and other needs by providing a ladder with at least one fixed axle (i.e., not a caster-type wheel) base wheel adapted to facilitate relocating the ladder. The ladder may be a step ladder or an extension ladder. The ladder includes a ladder base adapted to reside on a support surface, a ladder top opposite the ladder base, and ladder sides connected by steps, the ladder side extending between the ladder base and the ladder top. The base wheel is attached to one of the sides near the ladder base, and is adapted to rollably support the ladder base when the ladder is moved. The base wheel may be recessed into an opening on the ladder side to allow a larger diameter wheel to be used, or may be attached to the ladder using a surface mount bracket.

In accordance with one aspect of the invention, there is provided a ladder comprising a step portion with a fixed axle base wheel. The step portion comprises, a ladder base adapted to reside on a ladder support surface when the ladder is in use, a ladder top opposite the ladder base, first and second ladder sides extending between the ladder base and the ladder top, and steps connecting the ladder sides. The fixed axle base wheel preferably has an outside diameter between approximately three inches and approximately six inches, and more preferably approximately five inches, and is mounted to one of the ladder sides, proximal to the ladder base, and is preferably a roller scooter or a shopping cart type wheel, and more preferably a shopping cart type wheel. Advantageously, an opening may be provided in the ladder side to allow the wheel to partially intrude into the ladder to allow a larger wheel diameter without the wheel extending too far beyond the ladder side. The fixed axle base wheel is adapted to stably rollably support the ladder base when the ladder is being carried near the ladder top with steps nearly vertical (i.e., steps nearly perpendicular to the support surface or floor) and the ladder base, instead of being dragged, is rolled on the base wheel.

The ladder may be a step ladder having a hinged portion is connected to the step portion by a hinge at the ladder top, or an extension ladder with an extension portion slidably attached to the step portion. It is further contemplated to provide a second wheel, which is preferably a caster-type wheel, mounted to the same ladder side as the base wheel, proximal to the ladder top. If a second wheel is included, the ladder may similarly be rolled on the base wheel and second wheel.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1A:
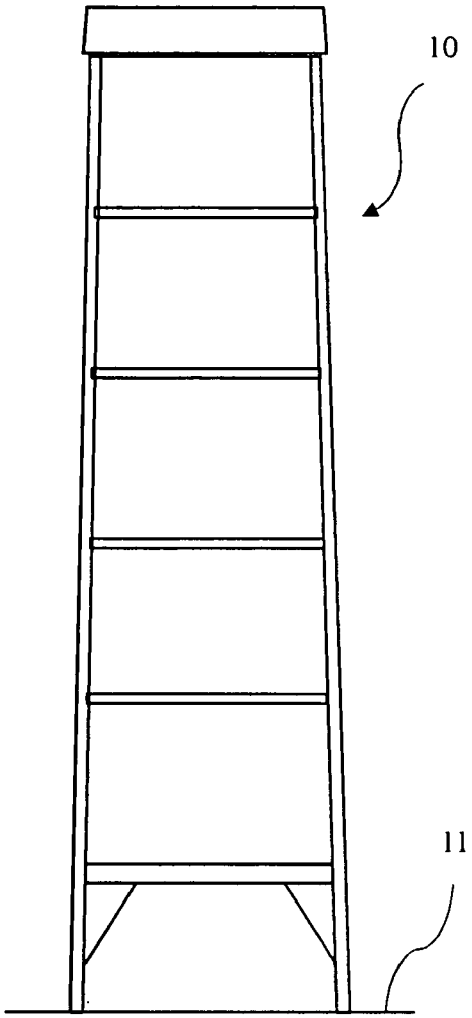
FIG. 1A (PRIOR ART)
FIG. 1A is a front view of a prior art step ladder positioned for use.
Figure 1B:
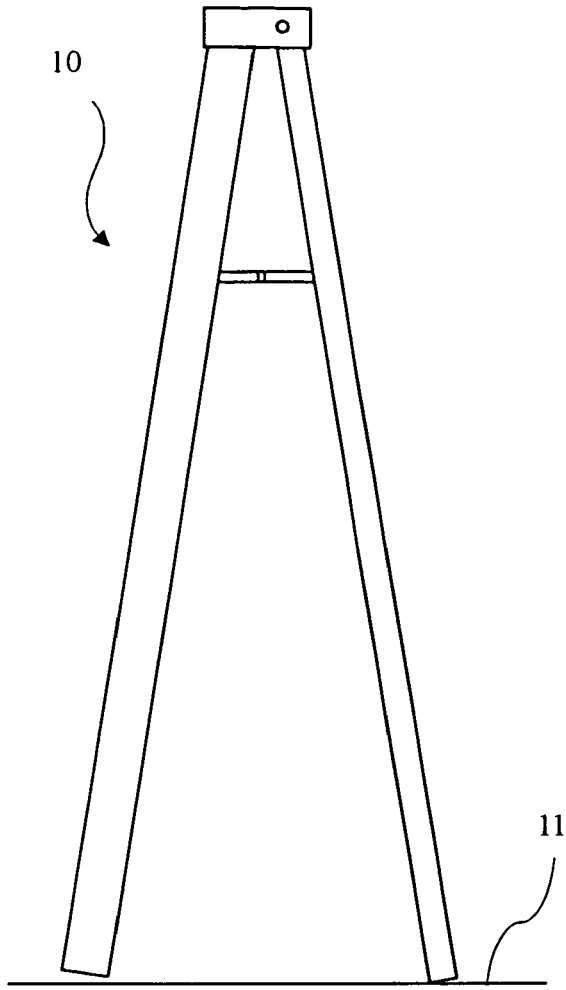
FIG. 1B (PRIOR ART)
FIG. 1B is an edge view of the prior art step ladder positioned for use.
Figure 2:
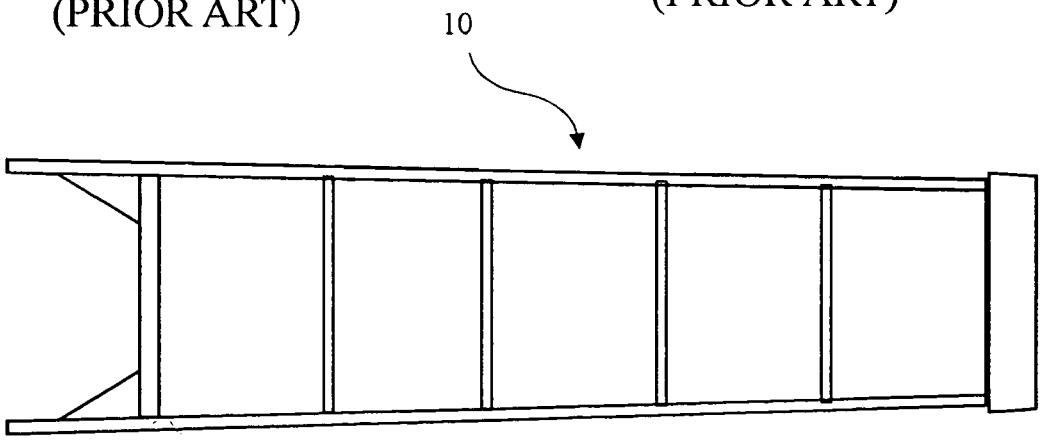
FIG. 2 (PRIOR ART)
FIG. 2 is a view of the prior art step ladder positioned for carrying.

A typical prior art step ladder is shown in FIG. 1A, and an edge view of the prior art ladder is shown in FIG. 1B. The prior art ladder is typically six to twelve feet high, and weighs up to forty five pounds or more. Such ladders are commonly used for painting, changing light bulbs, repairs to plumbing, etc. A view of the prior art step ladder 10 positioned for carrying is shown in FIG. 2. Extensive carrying of a twelve foot long prior art ladder is both fatiguing and may lead to spinal column injury.

Figure 3:
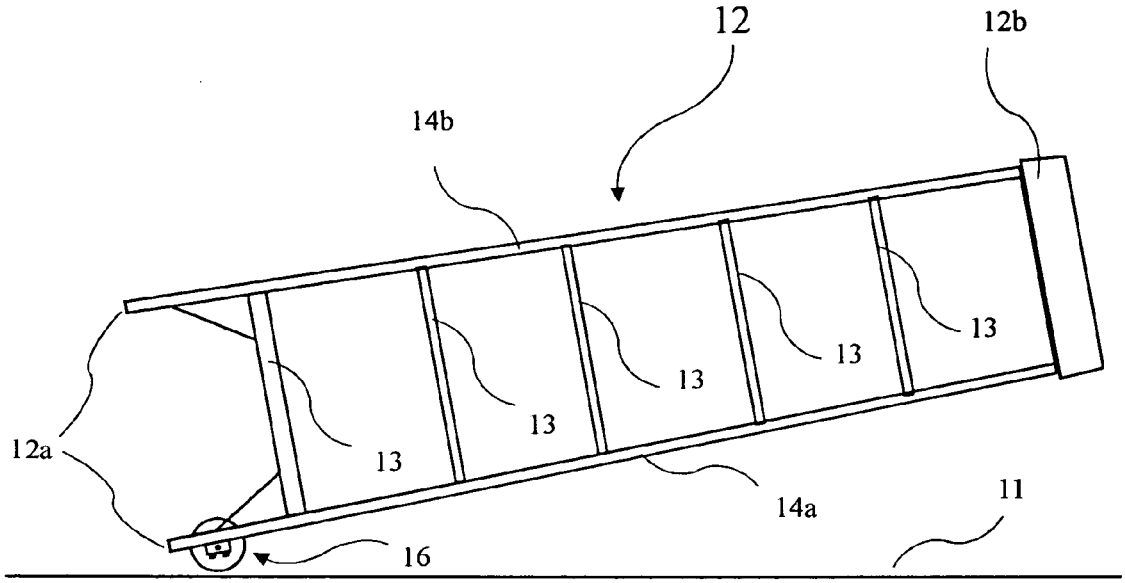
FIG. 3 is a view of a step ladder with a base wheel according to the present invention added to aid in transporting the ladder, with the ladder angled as it might be while being transported.

The present invention provides a easily transportable step ladder 12 adapted to facilitate stable carrying, as shown in FIG. 3. The ladder 12 includes a ladder base 12*a* adapted to rest on a support surface (or floor) 11 when the ladder 12 is in use, a ladder top 12*b* opposite the ladder base 12*a*, and ladder sides 14*a* and 14*b* with steps 13 attached thereto, ladder sides 14*a*, 14*b* extending between the ladder base 12*a* and the ladder top 12*b*. A fixed axle base wheel assembly 16 is attached to the ladder side 14*a* near the ladder base 12*a*, but may alternatively be attached to ladder side 14*b*. The ladder 12 is shown angled relative to the support surface 11 (i.e., ladder steps 13 nearly perpendicular to the support surface and said ladder top 12*b* lifted away from the floor), as the ladder 12 might be transported by carrying the ladder top 12*b*, and letting the ladder base 12*a* roll on the base wheel assembly 16.

Figure 4:
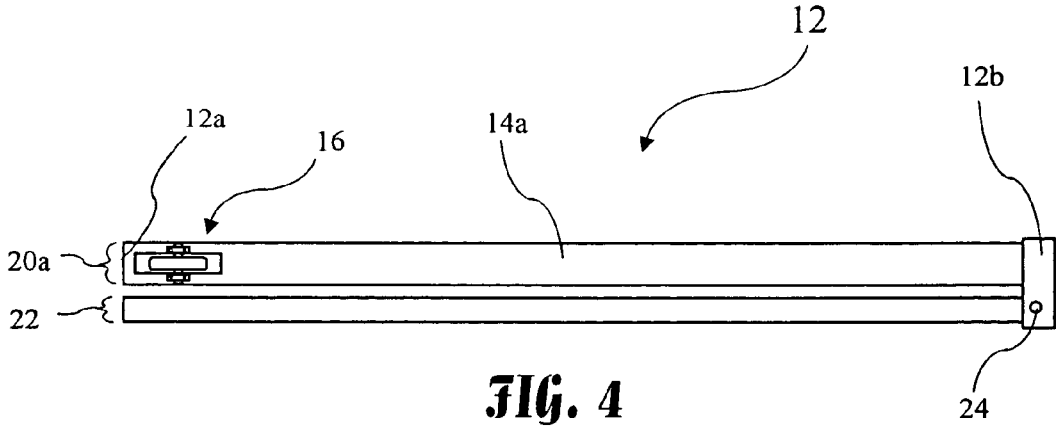
FIG. 4 is an edge view of the step ladder including the base wheel.

An edge view of the ladder 12 is shown in FIG. 4, comprising a first step portion 20*a* and a hinged portion 22. The step portion 20*a* is fixedly attached to the ladder top 12*b*, and the hinged portion 22 is pivotally attached to the ladder top 12*b* by a hinged portion pivot 24, and may alternatively be attached by hinges. The step portion 20*a* and hinged portion 22 may be constructed from wood, fiberglass, or metal, and are generally tapered being wider at the base and narrower at the top.

Figure 5:
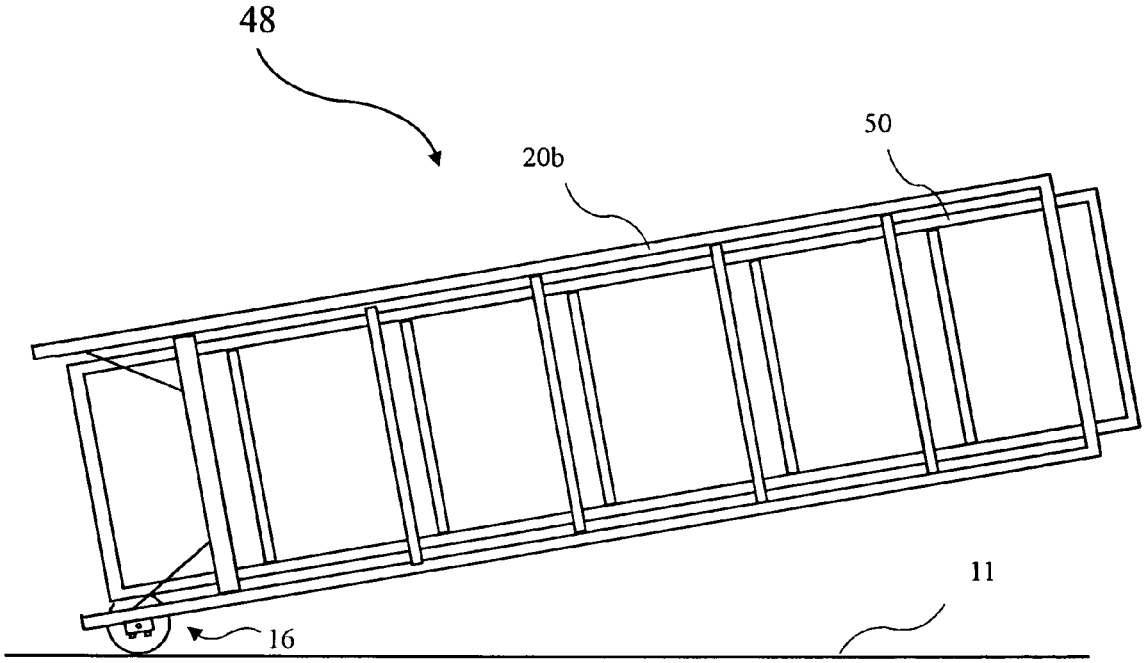
FIG. 5 is a view of an extension ladder with a base wheel according to the present invention added to aid in transporting the ladder, with the ladder angled as it might be while being transported.
Figure 6:
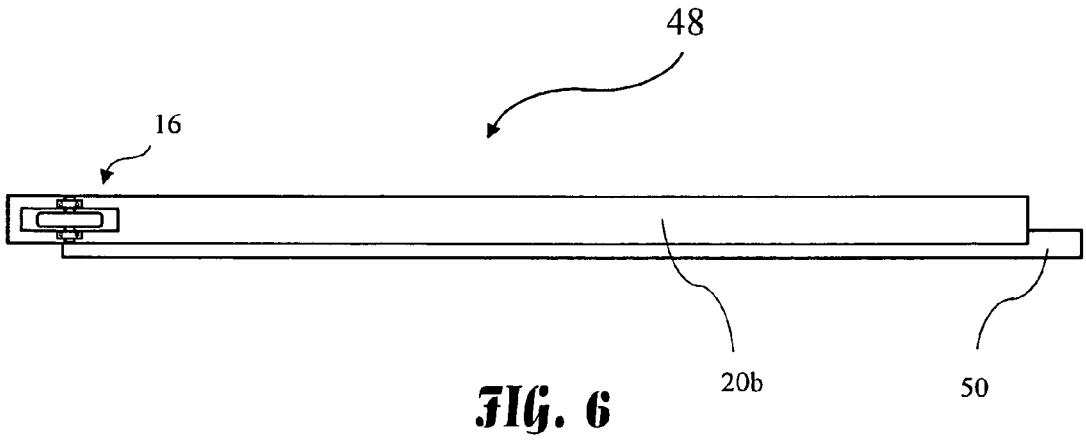
FIG. 6 is an edge view of the extension ladder including the base wheel.

An extension ladder 48 according to the present invention is shown in FIG. 5 and in edge view in FIG. 6. The ladder 48 comprises a second step portion 20*b*, an extension portion 50, and the fixed axle base wheel assembly 16. The extension portion 50 slidably cooperates with the step portion 20*b* to extend the ladder 48. The ladder 48 is shown in FIG. 5 angled relative to the support surface 11, as the ladder 48 might be transported by carrying the ladder top, and letting the base wheel assembly 16 roll on the support surface 11.

The present invention may further be applied to a ladder having a single portion (i.e., without a hinged portion or an extension portion), or a ladder with three or more hinged portions, or a combination of hinged and extension portions, and any ladder including at least one wheel assembly 16 as described above, is intended to come within the scope of the present invention.

Figure 7A:
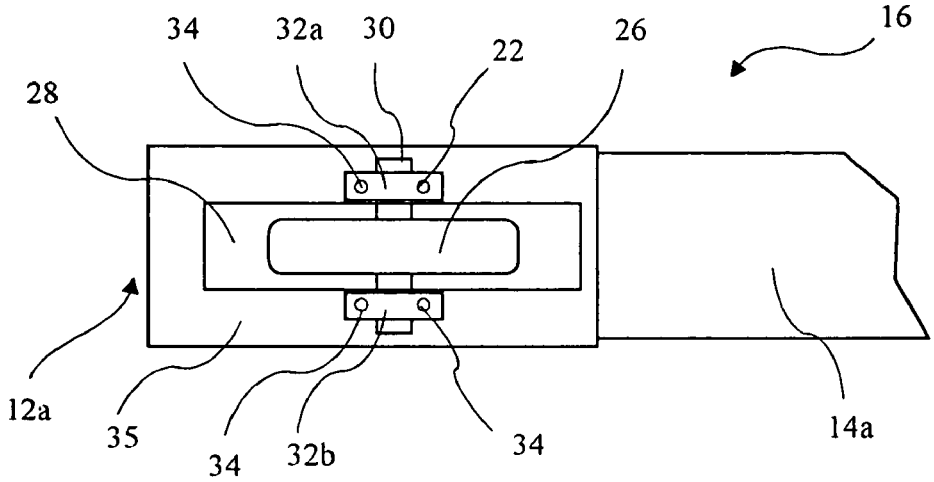
FIG. 7A is a detailed edge view of a base wheel assembly of the ladder.
Figure 7B:
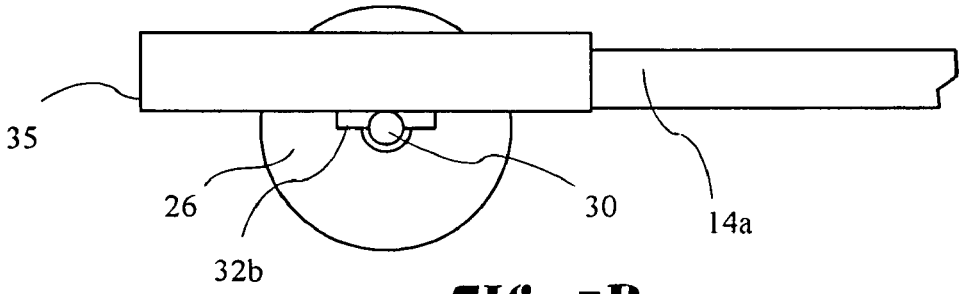
FIG. 7B is a detailed side view of a base wheel assembly of the ladder.

A detailed edge view of the fixed axle (i.e., not a caster-type wheel) base wheel assembly 16 of the ladders 12 or 48 is shown in FIG. 7A and an edge view is provided in FIG. 7B. The wheel assembly 16 includes a base wheel 26 with a base wheel fixed axle 30. The fixed axle 30 is supported by first and second axle supports 32*a* and 32*b*, and the major axis of the fixed axle 30 is substantially perpendicular to a plane parallel to the step portion 20*a*, i.e., perpendicular to a plane the steps 13 (see FIG. 3) lie in. The axle 30 is shown in FIG. 7B held in intimate contact with the ladder side 14*a* or 14*b*, as seen in FIG. 7B. The axle supports 32*a*, 32*b* are attached to the ladder side 14*a* by axle support bolts 34. The wheel 26 protrudes partially through a wheel opening 28 in the ladder side 14*a*. The base wheel assembly 16 is adapted to rollably support the ladder base 12*a* when either ladder 12 or 48 is being carried with steps 13 nearly perpendicular to the support surface 11 and the ladder base 12*a*, instead of being dragged, is rolled on the base wheel 26, and the ladder sides 14*a* and 14*b* are at a small angle to the relative to the support surface 11. For additional strength, a boot 35 may be extended past the wheel opening 28. Such boot 35 is preferably metal, and is shown in FIGS. 7A and 7B.

Figure 7C:
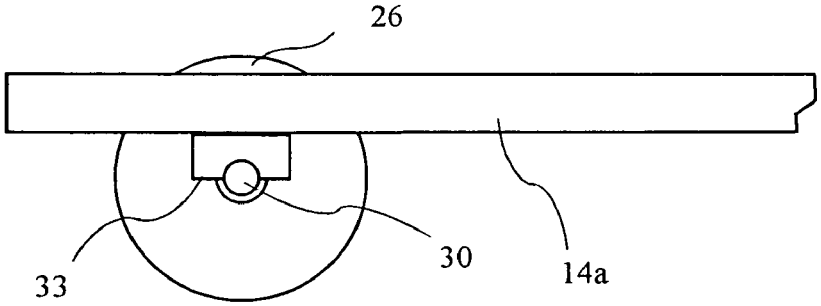
FIG. 7C is a detailed side view of a base wheel assembly of the ladder wherein the wheel is attached to the ladder using a stand-off.

An alternative embodiment of the wheel assembly is shown in FIG. 7C wherein the wheel 26 is attached to the ladder side 14*a* or 14*b* using a stand-off 33 to obtain greater ground clearance for the ladder 12 when being transported.

The base wheel 26 is preferably between approximately three inches in diameter and approximately six inches in diameter, and more preferably five inches in diameter. The base wheel 26 is preferably of the type commonly used on roller blades, roller scooters (i.e., is a roller-blade type wheel), or a shopping-cart type wheel, and more preferably a shopping-cart type wheel. The fixed axle 30 is between approximately two inches and approximately ten inches from said ladder base (i.e., measured along the length of the ladder).

Figure 8:
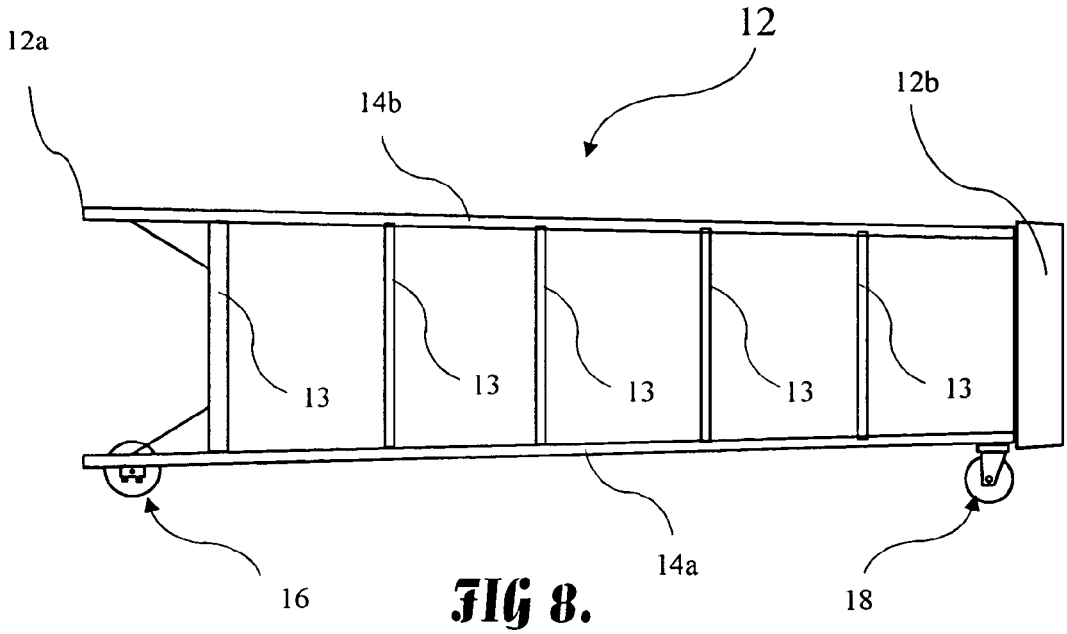
FIG. 8 is a second embodiment of the present invention with a caster wheel added near the ladder top of a step ladder.
Figure 9:
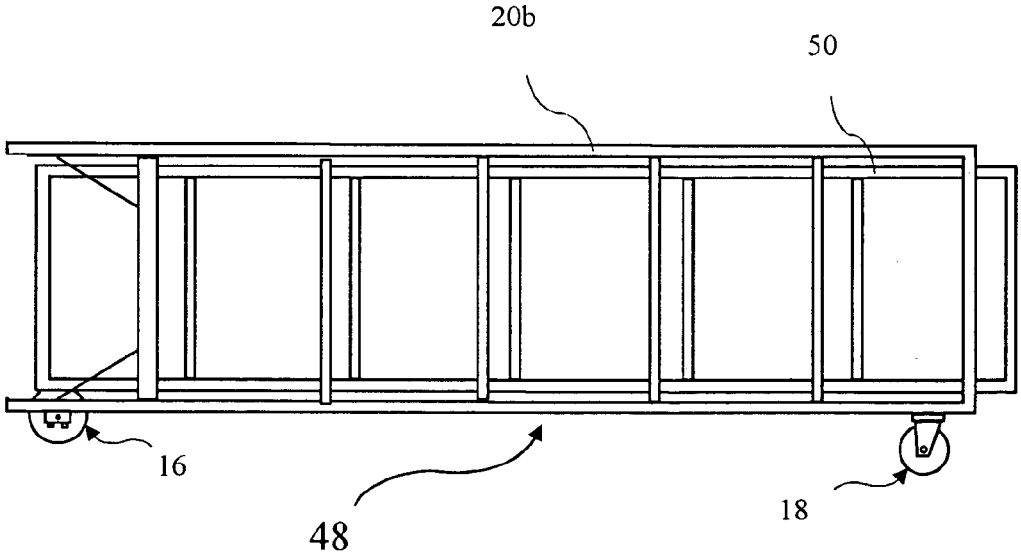
FIG. 9 is the second embodiment of the present invention with a caster wheel added near the ladder top of an extension ladder.

A step ladder 12 including a second caster-type wheel assembly 18 is shown in FIG. 8. The wheels assembly 18 is mounted on the same ladder side 14*a* or 14*b* as the base wheel assembly 16, but is mounted near the ladder top 12*b*. Thus mounted, the second wheel assembly 18 allows the ladder 12 to be guided without requiring lifting, thus further reducing fatigue. A view of the caster-type wheel assembly 18 mounted on the extension ladder 48 is shown in FIG. 9.

Figure 10:
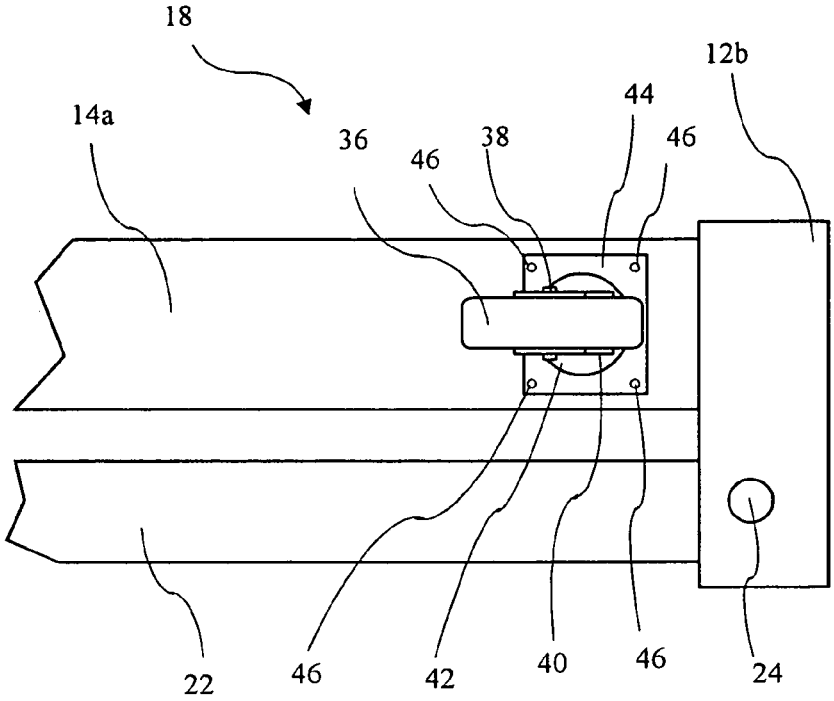
FIG. 10 is a detailed view of the caster wheel assembly on the step ladder.

A detailed view of the second wheel assembly 18 mounted to the ladder 12 is shown in FIG. 10. The wheel assembly 18 includes a second wheel 36 riding on a second wheel axle 38. The axle 38 is attached to a rearward sloping second axle support 40, which axle support 40 is typically a "U" shaped bracket. The axle support 40 is attached to a castor swivel 42, which caster swivel 42 is rotationally attached to a caster base 44. The caster base 44 is attached to the ladder side 14*a* by caster base bolts 46. The second wheel 36 is adapted to rollably support the ladder top 12*b* when the base wheel 26 and the second wheel 36 are in contact with the support surface 11. The wheel 36 is between approximately three inches in diameter and approximately six inches in diameter.

Figure 11A:
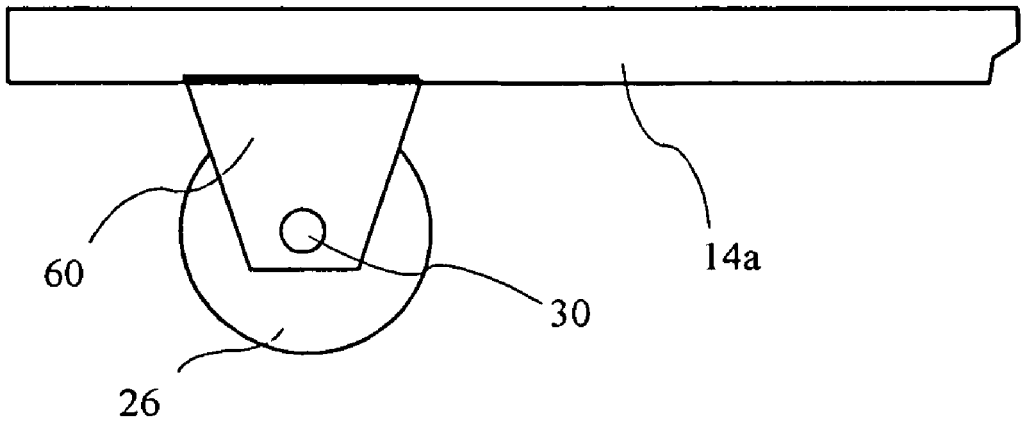
FIG. 11A is a side view of the wheel attached to the ladder using a riveted surface mount.
Figure 11B:
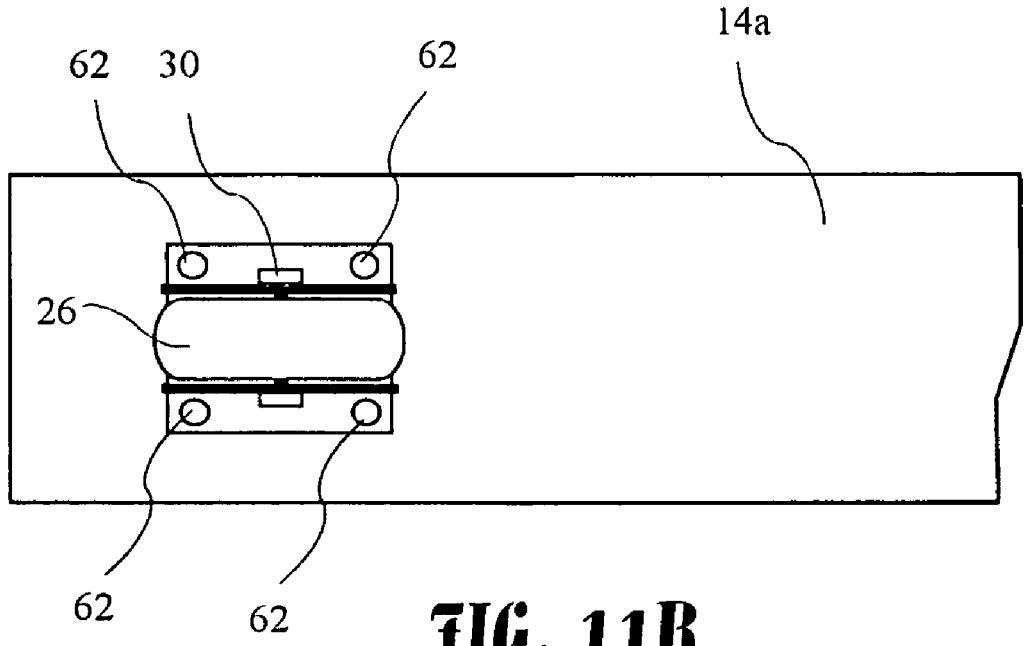
FIG. 11B is a bottom view of the wheel attached to the ladder using the riveted surface mount.

A side view of the wheel 26 mounted to the ladder side 14*a* using a surface mount 60 is shown in FIG. 11A. A corresponding bottom view of the wheel 26 mounted using the surface mount 60 is shown in FUG. 11B. The surface mount 60 is preferably attached to the ladder side 14*a* using rivets 62, and more preferably using four rivets 62.

Figure 12:
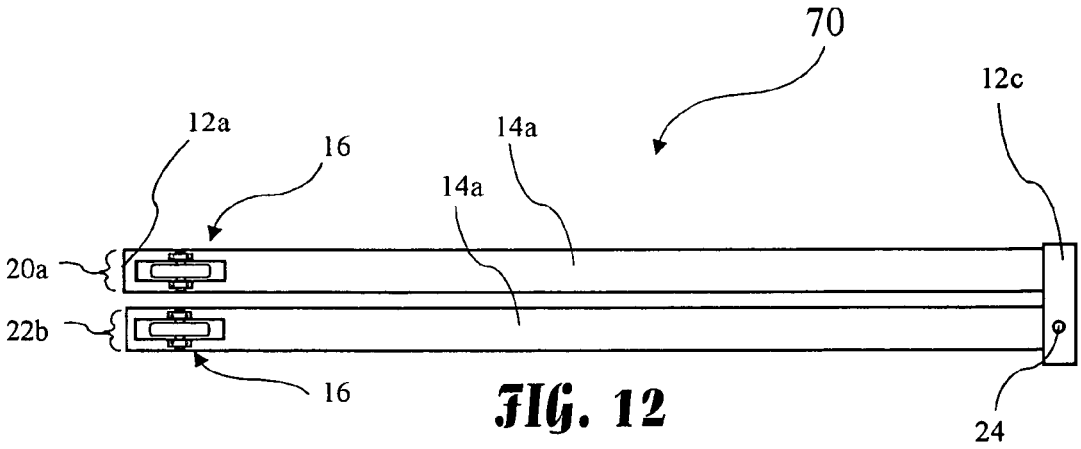
FIG. 12 is an edge view of a ladder having two base wheels.

An edge view of a two sided ladder 70 including a thick hinged portion 22*b* which includes a wheel assembly 16 adjacent to the wheel assembly 16 mounted to the stepping portion 20*a*, is shown in FIG. 12. Wheel assemblies 16 are included on each portion of the two sided ladder 70 to support the two similarly heavy portions of the two sided ladder 70. The hinged portion 22*b* may be a stepped hinged portion having thickness substantially similar to the stepping portion 20*a*.

While the invention herein disclosed has been described by means of specific embodiments and applications thereof, numerous modifications and variations could be made thereto by those skilled in the art without departing from the scope of the invention set forth in the claims.

I claim:

1. A step ladder comprising:

a step portion comprising:

ladder steps;

a ladder base adapted to reside on a ladder support surface when the ladder is in use;

a ladder top opposite said ladder base; and first and second ladder sides connected by said ladder steps and extending between said ladder base and said ladder top;

a wheel opening in one of a group consisting of the first ladder side and the second ladder side, wherein the wheel opening is proximal to the ladder base and positioned upwardly from said ladder base and is in a surface of the ladder base substantially perpendicular to the ladder steps;

an axle fixedly attached to the ladder side, the axle approximately centered on the wheel opening and substantially perpendicular to a plane passing through said ladder steps; and a wheel rotatably mounted to the fixed axle and an outer surface of said wheel extends inwardly as well as outwardly from said ladder side and does not protrude beyond the end of the ladder base to allow the end of the ladder base to engage the ladder support surface in a use position; a caster wheel attached to the ladder rail having the fixed axle wheel adjacent to the ladder top, wherein:

said fixed axle wheel is adapted to rollably support said ladder when said ladder steps are substantially perpendicular to the support surface, and said fixed axle wheel and said caster wheel are residing on the support surface.

2. The ladder of claim 1, wherein:

said fixed axle wheel is between approximately three inches in diameter and approximately six inches in diameter.

* * * * *